US007921487B2

(12) United States Patent
Stonier

(10) Patent No.: US 7,921,487 B2
(45) Date of Patent: Apr. 12, 2011

(54) TILTING FURNITURE SYSTEM AND INFINITELY VARIABLE LIFT TENSIONING MECHANISM THEREFOR

(76) Inventor: Russell Stonier, Chicago, IL (US)

( * ) Notice: Subject to any disclaimer, the term of this patent is extended or adjusted under 35 U.S.C. 154(b) by 453 days.

(21) Appl. No.: 11/986,357

(22) Filed: Nov. 23, 2007

(65) Prior Publication Data

US 2008/0163421 A1 Jul. 10, 2008

(51) Int. Cl.
*A47C 19/00* (2006.01)

(52) U.S. Cl. ..... 5/164.1; 5/136; 5/159.1

(58) Field of Classification Search ..... 267/173; 5/2.1, 3, 4, 5, 136, 159.1, 160, 164.1
See application file for complete search history.

(56) References Cited

U.S. PATENT DOCUMENTS

| | | | | | |
|---|---|---|---|---|---|
| 801,658 | A | * | 10/1905 | Fuller | 5/145 |
| 921,952 | A | * | 5/1909 | Cote | 5/168 |
| 2,709,057 | A | * | 5/1955 | Gould | 248/543 |
| 2,822,568 | A | * | 2/1958 | Hosea | 16/290 |
| 3,550,167 | A | * | 12/1970 | Bennett | 5/136 |
| 4,564,964 | A | * | 1/1986 | Pardo Herrera | 5/164.1 |
| 4,766,623 | A | * | 8/1988 | Beihoffer et al. | 5/164.1 |

FOREIGN PATENT DOCUMENTS

GB 2041066 A * 9/1980

* cited by examiner

*Primary Examiner* — Robert A Siconolfi
*Assistant Examiner* — Stephen Bowes
(74) *Attorney, Agent, or Firm* — James G. Staples

(57) ABSTRACT

A tension mechanism for use with existing conventional bed platforms in the well known Murphy bed system in which the bed platform may be connected to the tension mechanism when the tension is at a low level by only a single installer, and the tension thereafter increased in infinite increments to any desired level by a remotely operated tool.

2 Claims, 5 Drawing Sheets

TILTING FURNITURE SYSTEM AND INFINITELY VARIABLE LIFT TENSIONING MECHANISM THEREFOR

This invention relates generally to multi-purpose furniture and specifically to a tilting furniture system and, individually or in combination therewith, an infinitely variable lift tensioning mechanism therefor. It is particularly suited for a tilting bed assembly of the type known for decades as a Murphy bed, but it is also adapted for use with auxiliary furniture elements, such as a desk in combination with a Murphy, or tilting, bed.

BACKGROUND OF THE INVENTION

There has been a trend for some years in many metropolitan areas to increase population density in both new and rehabbed buildings. In areas having building codes which permit increased density, a given floor space is more and more frequently required to serve dual purposes: daytime living and/or working space followed by nighttime sleeping space. The Murphy bed concept, which was commercially introduced over a century ago, is ideally suited to this new trend since the floor space occupied by a bed at night is available as working space during the daytime, the bed being tilted upwardly to a vertical position in which it is in abutting contact with, or received in a recess in, an adjacent wall at night.

In recent years auxiliary furniture has been combined with the bed, such as a desk, the desk being arranged to be in an open working position during the day when the bed is in its out of use upright position, and then at night the desk being in a non-usable, out of the way position when the bed is in its horizontal, use position.

Although the general concept has been known for some time, certain difficulties have persisted over the years. One such difficulty is associated with the spring mechanism which is employed to raise and lower the bed, and auxiliary furniture if present. Specifically, many of the spring mechanisms in existing systems are very difficult to operate over portions of the operating cycle, such as the first portion of movement of the bed from its open, use position (when it is parallel to the floor) as it begins its upward movement toward its associated wall. In some cases as much as about fifty pounds of force may be required to initiate the upward tilting movement of the bed and this degree of force is difficult to apply for elderly people, or people of slight stature such as a woman who may weigh only about 110 pounds or less. There is therefore a need for a spring tilting mechanism which can be activated with only a few pounds of force over its entire range of movement including the commencement of bed movement from a horizontal to a vertical position.

A further drawback to many existing tilting mechanisms is that installation of a bed platform to a spring mechanism requires two installers.

It has also been thought that many existing tilting mechanisms could advantageously be made more user friendly and safer in operation.

SUMMARY OF THE INVENTION

The invention includes, in an initial configuration, a spring tilting mechanism in which the necessity of inserting the hand or fingers of an installer into close proximity to the tilting mechanism next to the wall is eliminated during connection of a conventional bed platform to the tilting mechanism.

The invention has the further advantage that no change is necessary to the conventional configuration of the means for assembling and locking the conventional bed platform to the tilting mechanism whereby redesign of the bed platform and the support structure for the spring mechanism is avoided.

In addition, the invention has the advantage that the lift tensioning mechanism for actuating the load, such as a bed, may be infinitely variable using only a simple hand tool operable at a safe distance from the lift tensioning mechanism.

The invention also contemplates, in an expanded configuration, a bed and an associated piece of furniture, such as a desk, which includes the aforementioned spring mechanism so that the bed may still be tilted upwardly to an inoperative position or downwardly to an operative position by application of only the modest force earlier described, the desk remaining level at all times.

BRIEF DESCRIPTION OF THE DRAWING

The invention is illustrated more or less diagrammatically in the accompanying drawing in which.

DESCRIPTION OF A SPECIFIC EMBODIMENT

Figure 1:
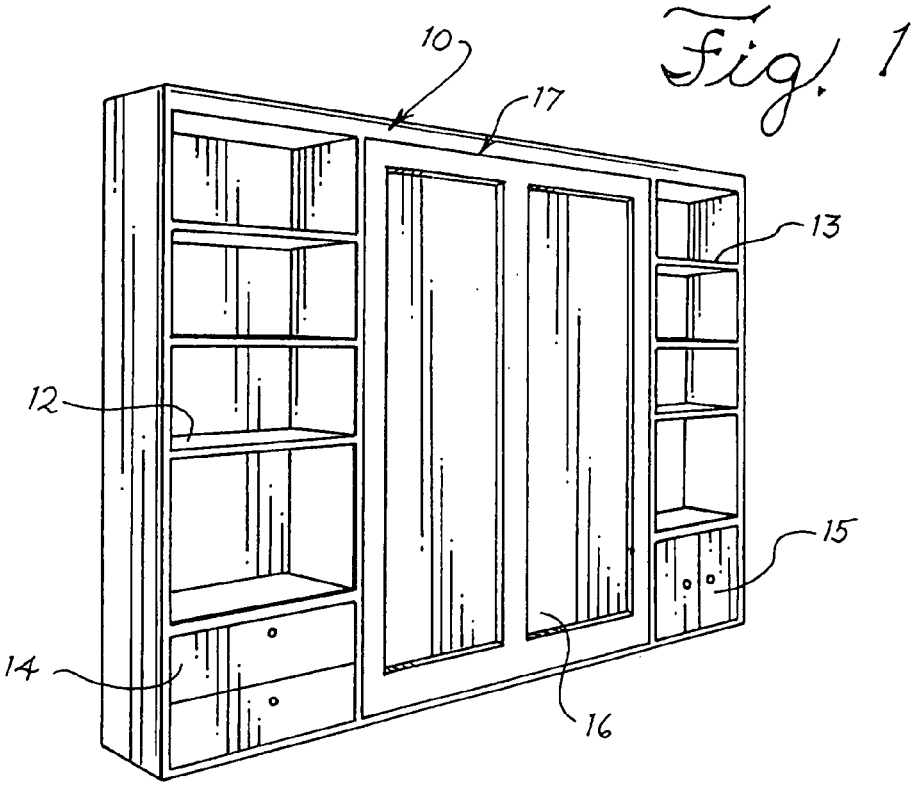
FIG. 1 is a perspective view of a bed assembly of the invention in an upright, out of use, stored position, here stored in a piece of furniture having a recess which is flanked by bookshelves.

Like reference numerals will be used to refer to like or similar parts from Figure to Figure in the drawings.

Figure 2:
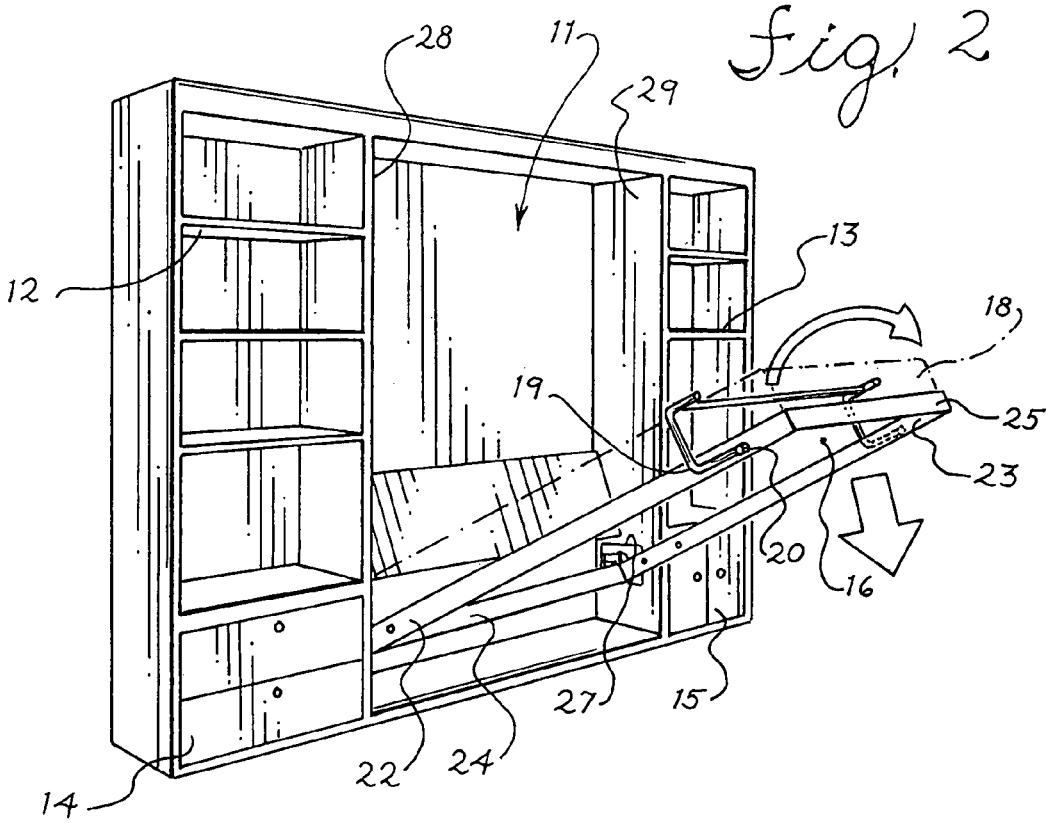
FIG. 2 is a perspective view of the bed assembly of FIG. 1, with parts broken away for clarity, in a position part way downward towards its in use position on the floor.

Referring first to FIG. 1, a tiltable bed assembly is indicated generally at 10 in its vertical, out of use position, the bed assembly being received within a recess 11 which is shown best in FIG. 2. In this instance a plurality of shelves are indicated at 12 and 13 and drawers or doors at 14 and 15 flanking the bed assembly 10. It will be understood that the underside 16 of the bed platform, which is indicated generally at 17, may be flush with a wall surface, or the unit may be a stand alone assemblage whose backside butts against an associated wall.

Figure 3:
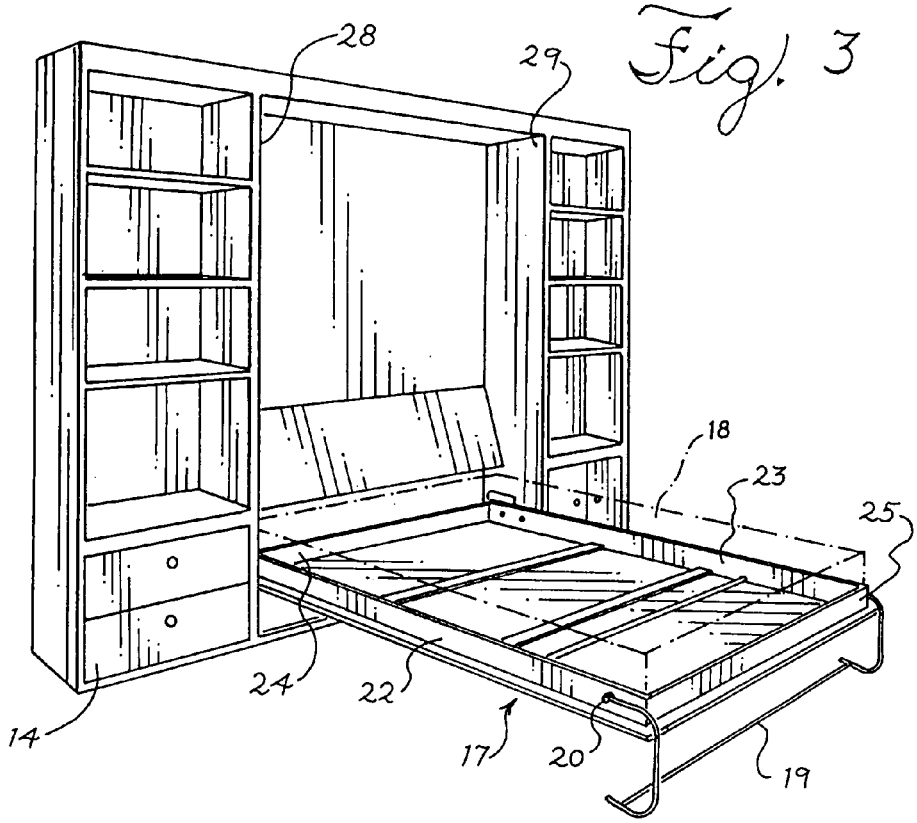
FIG. 3 is a perspective view of the bed assembly of FIGS. 1 and 2 in a use position.

The bed assembly 10 includes, in addition to the bed platform 17, a mattress, indicated in phantom at 18 in FIGS. 2 and 3, and a support leg 19 which pivots around pivot pins 20 located near the outer extremity of side rails 22 and 23 of bed platform 17. The support leg 19 is shown in its stored, mattress restraining position in FIG. 2, and in its fully pivoted, in use position in FIG. 3. The bed platform includes head rail 24 and foot rail 25, the bed platform being pivotable about a pivot, later described, associated with a lever actuated spring mechanism indicated generally at 27 in FIG. 2. The lever actuated spring mechanism 27 is fixedly secured to right and left side support members 28, 29.

Figure 5:
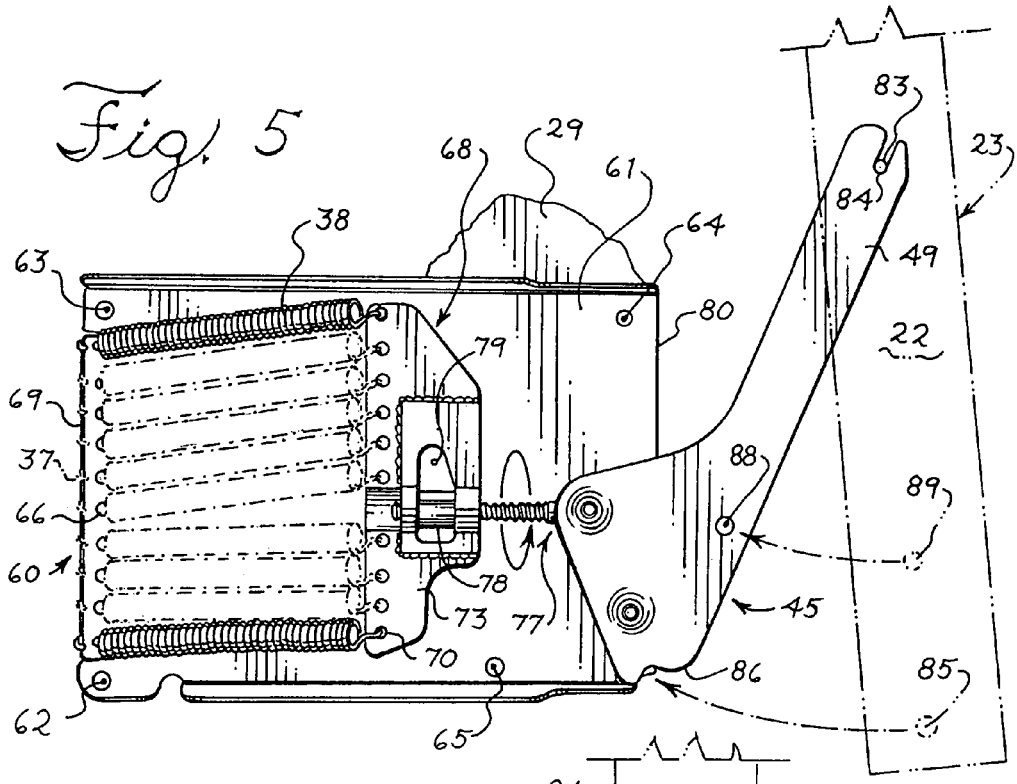
FIG. 5 is a side view of the spring mechanism of the present invention in its condition for a standard king size bed when a bed platform has been engaged to the spring lever prior to locking.
Figure 6:
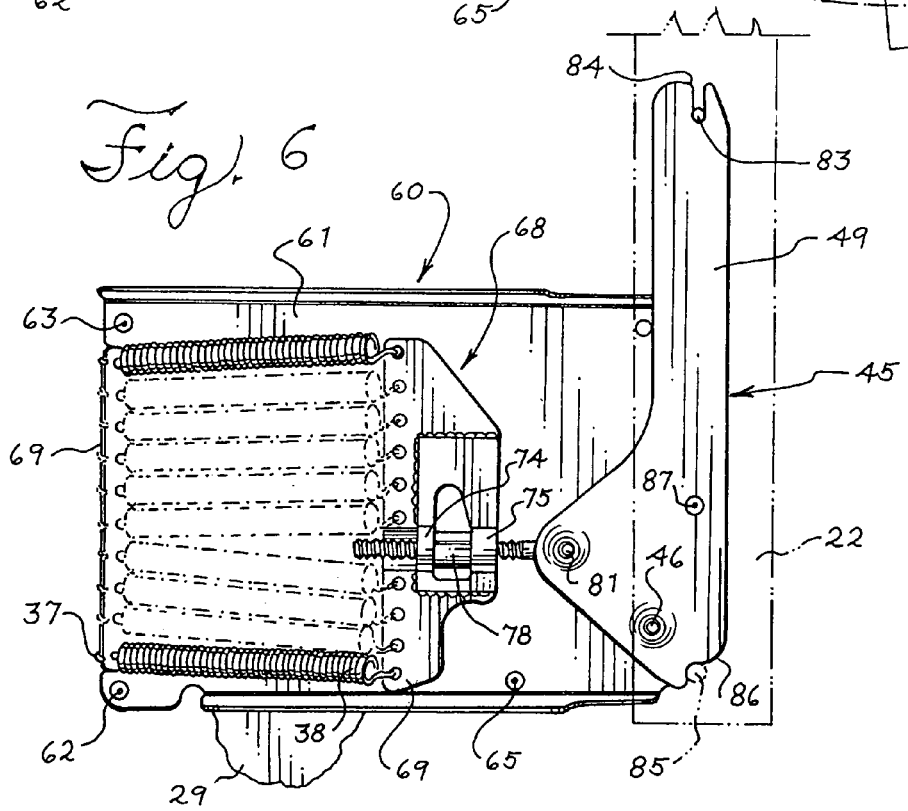
FIG. 6 is a side view of the bed platform of the present invention locked to the spring lever of the spring mechanism after the spring mechanism has been operated to ensure that the bed platform will be vertical in its out of use condition.

Referring now to FIGS. 5 and 6 a new and unique, infinitely variable lever actuated spring mechanism for moving a load about a fixed axis, here embodied in a lever actuated spring mechanism and bed platform connector system for a standard king size bed, is illustrated in which all danger to a bed platform installer is eliminated, and, with practice, only one installer is required to assemble a bed platform to the spring mechanism and connector. Further, a single installer can safely adjust the tension in the spring mechanism by infinite gradations from a remote location without regard to the orientation of the spring mechanism with respect to the bed platform connector, and without regard to whether a bed platform is, or is not, connected to the bed platform connector.

Figure 4:
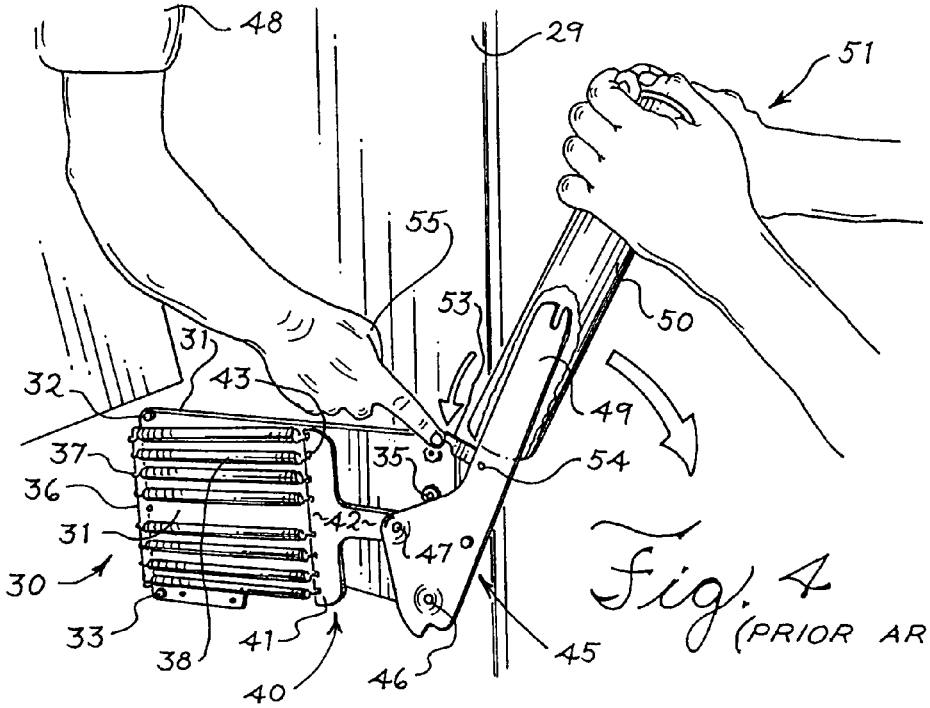
Fig. 4 (PRIOR ART)
FIG. 4 is a perspective view of a common current type of spring mechanism used to connect a bed platform to a spring tilting mechanisms.

Referring now to FIG. 4 a widely used prior art spring mechanism is indicated generally at 30. It includes a base plate 31 secured to, here, a right vertical side support member 29 by bolts 32, 33, 34 and 35. The rear of spring mechanism 30 includes a flange 36 which is perpendicular to the plane of the base plate 31, the flange 36 having a plurality of holes, here eight, to receive the hook 37 at the inner end of each of eight springs 38. A T-shaped tension bar is indicated generally at 40, the tension bar 40 having a base section 41 which is integral with a connector bar 42. The left or inner end of tension bar 40 has a plurality, here eight, holes, not numbered for the sake of clarity, each of which receives a hook 43 at the outer end of an associated spring 38.

A lever for connecting the spring mechanism 27 to the bed platform 17 is indicated generally at 45, the lever being pivotally connected to right side support member 29 at 46. The connector bar 42 is pivotally connected at 47 to the lever 45 so that as lever 45 rotates clockwise and counterclockwise about a spatially fixed pivot 46, the springs 38 will be extended or tensioned, and relaxed, respectively.

The upwardly projecting end 49 of lever 45 is received within a short length of pipe 50 which provides leverage for rotating the lever 45 clockwise about pivot 46 against the increasing tension of spring 38 by hand applied pressure generated by a first installer indicated generally at 51.

It is necessary in this conventional prior art construction to rotate the lever 45 to the illustrated position in order to enable the temporary locking arm 53, which is pivotally connected to the lever 45 at 54, to be swung in a generally horizontal plane by the second installer 48 until the slotted end of the temporary locking arm 53 slips over bolt 34 to hold the lever 45 in the illustrated position preparatory to receiving the inner end of the bed platform 17.

Swinging the temporary locking arm 53 in a generally horizontal plane to cause it to engage bolt 34 can only be done by a second installer 48 pressing his finger 55 against the temporary locking arm 53, since the first installer 51 must hold the lever 45 in the illustrated position. As a consequence, in this currently used system, two installers are an absolute necessity.

Referring now to FIGS. 5 and 6 a new and unique, infinitely variable lever actuated spring mechanism for moving a load about a fixed axis, here embodied in a lever actuated spring mechanism and bed platform connector system for a standard king size bed, is illustrated in which all danger to a bed platform installer is eliminated, and, with practice, only one installer is required to assemble a bed platform to the spring mechanism and connector system. Further, a single installer can safely adjust the tension in the spring mechanism by infinite gradations from a remote location without regard to the orientation of the spring mechanism with respect to the bed platform connector, and without regard to whether a bed platform is, or is not, connected to the bed platform connector.

The new and improved spring mechanism of the present invention is indicated generally at 60 mounted on a vertical side support member 29. The spring mechanism 60 includes a backing plate 61 whose right end is indicated at 80 which is secured to the side support member 29 by recessed bolts 62, 63, 64 and 65. A plurality of conventional coil springs, here ten in number, are indicated at 38. Although the appropriate number of coil springs for a conventional king size bed, ten, have been chosen as a specific embodiment to illustrate the invention, it will be understood that the number of springs will vary in conformity with the size of the bed.

Thus, seven or eight springs per spring mechanism for a total of 14 to 16 springs are appropriate for the standard double bed in the United States, nine springs per spring mechanism for a total of eighteen springs are appropriate for a standard queen size bed in the United States, and only five springs per spring mechanism for a total of ten springs are appropriate for a standard single bed in the United States. The illustrated king bed mechanism is however appropriately representative of the single, double and queen size beds as those skilled in the art will appreciate.

It has been discovered that the physical characteristics and configuration of the individual spring when related to the bed size is essential for the optimum efficiency of the spring mechanism, a concept not heretofore appreciated.

Specifically, and assuming the average weight of a conventional bed board and mattress unit, it has been discovered that each spring requires 43 coils per standard 6¾ inch relaxed length of the spring using a spring wire of 130 mm in diameter. Indeed, it has been found that what would appear to be an interchangeable configuration of 45 coils of 125 mm wire in a standard 6¾ inch relaxed length of spring is sufficient to perform satisfactorily. Conventional piano wire has been found to be satisfactory.

Thus, since each spring, when extended from its relaxed length of 6-¾inches (which is common to single beds to king sized beds) is extended to its full elongated length of 10-¾ inches (which is also common to single beds to king sized beds), 220 pounds of pull is developed. Thus in the illustrated ten springs per spring mechanism 60, a total of twenty springs, or 4,400 pounds of pull are developed. By the same token, almost 4,000 pounds of pull are developed in a nine spring per spring mechanism queen size bed construction.

It will be understood that due to the highly competitive nature of this industry and the consequent extensive standardization of as many components as possible, such as lever 45 which is characteristic of 100%, or very nearly 100% of all Murphy beds today, the distance between the left end of stationary base member 61 and spatially fixed pivot point 81 is such that, to provide space for tension bar 40 of the prior art or its inventive replacement, tensioning yoke 68, the relaxed length of the spring must be 6-¾ inches and the extended length 10-¾ inches.

The left end of each spring terminates in a hook 37 which passes through an associated hole 66 in stationary base member 61 and curves around the left end 69 of the stationary base member 61.

The tensioning yoke, which is indicated generally at 68, has a flat left portion 82 which lies in sliding contact with the adjacent surface of stationary base 61. Left portion 82, which forms a spring member, has a plurality of holes 70, here ten, each of which receives the yoke hook 71 at the right end of each spring 38. The tensioning yoke 68 and the springs 38 comprise a spring mechanism, or more specifically, a tensioning assembly structure.

The right portion 73 of yoke 68 carries structure for varying the tension of the spring 38. Said structure includes two generally aligned bossers 74, 75 integral with and projecting perpendicularly from, tensioning yoke 68. The bosses have coaxial threaded bores therein of identical diameter and thread size. A threaded member, here a threaded eye-bolt, is indicated at 77, the threaded shank of the eye-bolt being received in the coaxial threaded bores in bosses 74, 75. The right end of eye-bolt 77 is pivotally connected to lever 45 at 81. In FIG. 5 the eye-bolt 77 is shown spaced outwardly away from its retracted position and in FIG. 6 the eye-bolt is shown in its retracted position. By comparing the position of lever 45 in FIGS. 5 and 6 it will be noted that the range of movement of the lever 45 about pivot 46 in this preferred embodiment is about 45 degrees. Likewise it will be noted by comparing the positions of pivot connection 81 in FIGS. 5 and 6 that the arc of movement of pivot connection 87 of the spring anchor member to the lever is relatively flat. As a consequence the spring mechanism 68 is in a generally horizontal position throughout the entire arc of movement of the pivotal connection 81. It will also be understood that the FIG. 5 position illustrates a convenient spacing of the parts suitable for installing the bed platform to the spring mechanism. The eye-bolt is also threaded through a hex head nut 78 which is received in the aperture 79 in the right portion 73 of yoke 68, the shank of the eye-bolt being threaded through the internal thread of the nut 78. The aperture 79 is extended radially outwardly from the aligned axes of the bosses 74, 75 to provide easy access for an adjusting tool, such as a crescent wrench, to rotate nut 78. Linear movement of the nut with respect to the outer end of the tensioning assembly, is thereby precluded. As a result, the eye-bolt 77 may move inwardly toward the left end 82 of the tensioning assembly, or outwardly toward the right end 73 of the tensioning assembly.

The lever 45 of this embodiment has the same configuration as the standardized lever 45 of the prior art embodiment of FIG. 4. Thus no reconfiguration of the conventional lever is required.

Lever 45 is pivotally connected as at 81 to the threaded eye-bolt 77. Since the yoke 68 is not secured to the stationary base member 61, the yoke 68 merely slides very slightly upwardly, as shown in FIG. 5, or very slightly downwardly, as shown in FIG. 6, as the pivotal connection 81 of the eye-bolt 77 moves upwardly and downwardly following movement of lever 45. In other words, the spring mechanism 60 and the springs 38 remain generally horizontal in all positions of the bed to a floor, as a comparison of FIGS. 5 and 6 will instantly disclose. It will be noted that pivotal connection 81 of the tensioning assembly to the lever 45 always lies above the spatially fixed lever pivot 46 so that pivot 81 moves along a relatively short flat arc above pivot 46.

The side of bed platform 23 carries an upper seating pin 83 which is proportioned to be received in vertical seat 84 in the upper end of lever 45. A lower seating pin 85 is carried by the lower end of the bed platform side rail and so spaced from upper seating pin 83 that when the bed platform is swung from the partially engaged position of FIG. 5 to the fully engaged position of FIG. 6, the lower seating pin 85 will seat in the notch 86 at the lower end of lever 45. Once the pins 83 and 85 are in their seated positions of FIG. 6, a locking pin 87 is passed through aligned holes 88 in lever 49 and 89 in side rail 22 to lock the bed platform 17 to the spring mechanism.

By virtue of the infinitely variable relationship between the fixed spring backing plate 61 and the adjustably positioned lever 45, the spring tension may be so precisely adjusted that only a few pounds of force, less than 10, is all that is required to pull the bed platform 17 and mattress 18 down, or lift them up.

Referring now to the embodiment of FIGS. 7 through 10, a combination tiltable bed and desk assembly is illustrated generally at 92. The assembly is mounted in a rigid support frame consisting of left side wall 93, right side wall 94, top wall 95 and rear-bottom base member 96, see FIGS. 8-10.

The combination tiltable bed and desk assembly includes a bed assembly indicated generally at 98, and a desk assembly indicated generally at 99.

The bed assembly includes a bed platform 100 having a base 101 and upstanding side edge walls 102, only the right side edge wall appearing in the drawing. A front wall is indicated at 103 and rear wall at 104, see FIG. 9, said walls receiving and confining a mattress 105. The spring mechanism 60 of FIGS. 5 and 6 are secured to the left and right side walls 93 and 94, each spring mechanism including a lever 45 which is pivoted at 46, see FIG. 8, to the backing plate 61 and hence to the left and right side support walls 93 and 94. The connector 45 is secured to the bed platform 100 as indicated in FIG. 6.

The desk assembly 99 includes the flat working surface member 108 having upstanding left and right side walls 109, 110 and rear wall 112.

Figure 8:
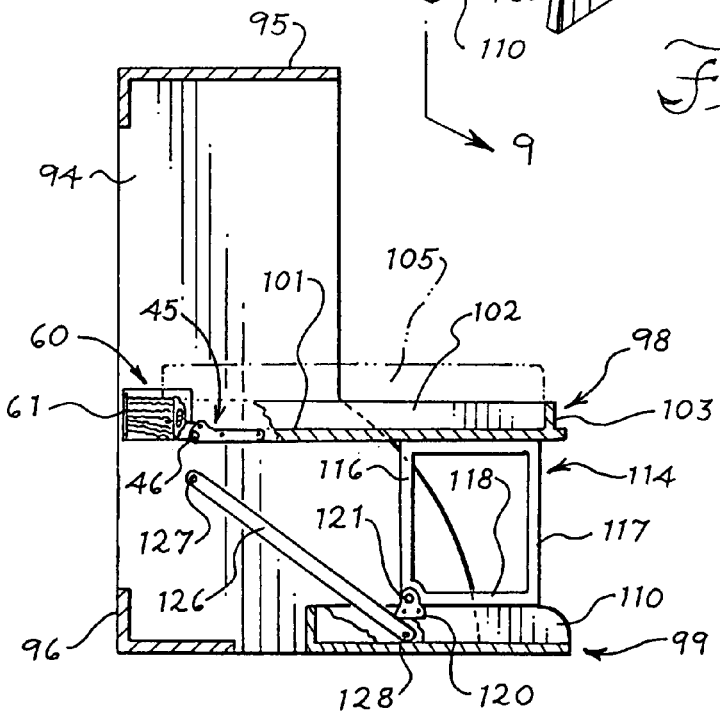
FIG. 8 is a sectional view of the bed and desk system of FIG. 7 with parts broken away and others in phantom for purposes of clarity.

Left and right support members 113 and 114 extend downwardly from end portions of the bed platform base 101, the support members in this instance being rigid box frames having a top 115 secured to the outer end portions of bed platform 101, legs 116 and 117 which extend perpendicularly outwardly from the ends of top 115, and base member 118. When the bed platform base 101 is in its horizontal bed use position of FIG. 8 the base members 118 of the rigid box frames 113 and 114 are aligned with, and rest upon, the upper edges of their associated left and right side walls 109 and 110 of the flat working surface member 108 as best seen in FIG. 8. The box frames 113 and 114 are connected to the flat surface member 108 by a bracket 120, see FIG. 8, which is pivoted to a side wall, such as right side wall 110 of FIG. 8, by a pivot 121.

Figure 9:
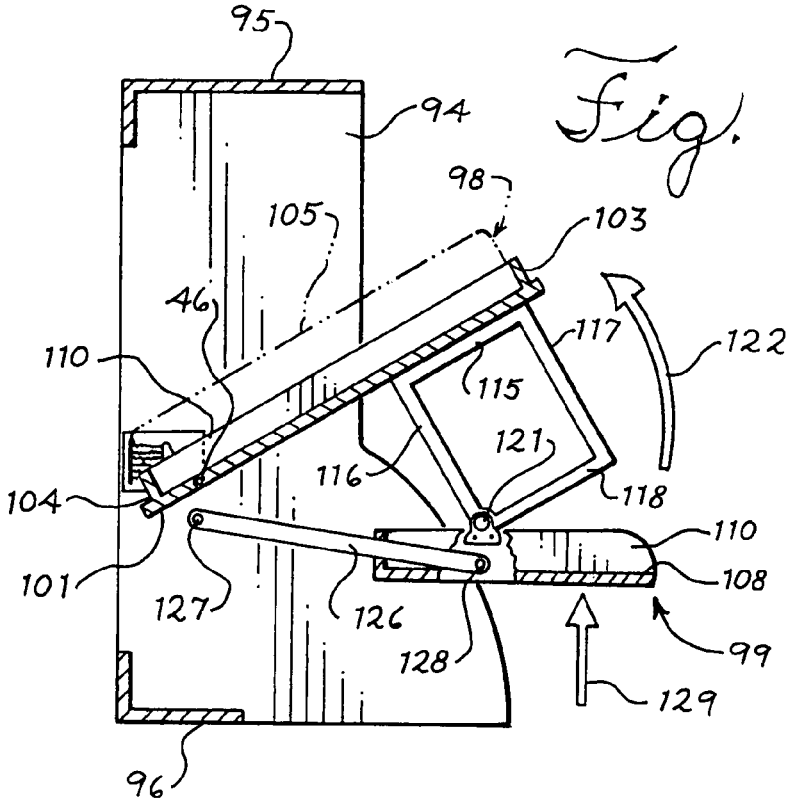
FIG. 9 is a sectional view of the bed and desk system of FIG. 7 about midway in its travel from a position in which the bed is in use to the position in which the bed is stored, taken substantially along the line 9-9 of FIG. 7.
Figure 10:
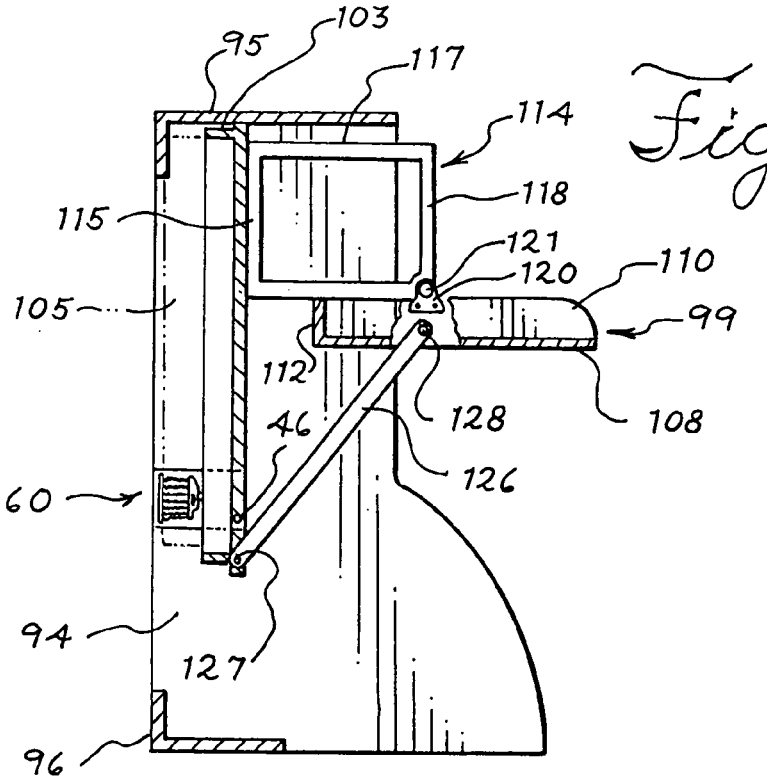
FIG. 10 is a sectional view of the bed and desk system of FIG. 7 in which the bed is in its stored position and the desk is in its use position.

The desk top 108 moves with the bed base 101 as the bed moves from its in use position of FIG. 8 through an arc of movement represented by arrow 122 of FIG. 9 and into the bed stored position of FIG. 10.

The desk top 108 is maintained horizontal throughout the entire path of travel from the FIG. 8 to the FIG. 10 position, and in the reverse movement, by the bed-desk linkage system indicated generally at 124, see FIG. 10.

The bed-desk linkage system 124 includes a link 126. The link 126 is pivotally connected at its inner end to the right side wall 94 at 127 and its outer end is pivotally connected to the outside of side wall 110 at 128. From a comparison of FIGS. 8, 9 and 10 it will be seen that the distance between pivots 127 and 128 of link 126 equals the distance between pivot 46 and pivot 121, and that the geometrical lines formed by said distances are parallel. By the same token, the distance between pivot 46 and pivot 127, firstly, and the distance between pivot 121 and pivot 128, secondly, are equal. In other words, pivots 46, 121, 128 and 127 form a parallelogram linkage so that as the desk 108 moves from the daytime in use position of FIG. 10 to the nighttime out of use position of FIG. 8, and vice versa, the desk will remain flat so that round objects as well as flat objects may remain on the desk throughout the 24 hours of the day.

Figure 7:
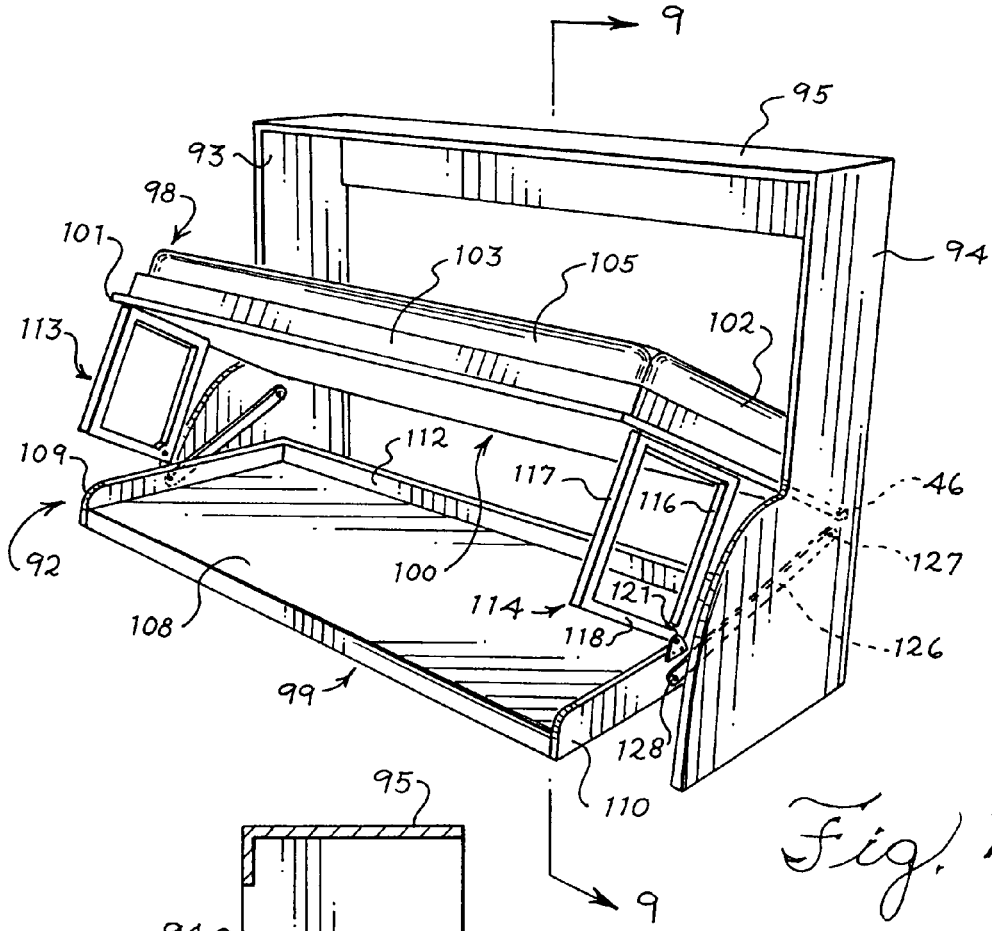
FIG. 7 is a perspective view of another embodiment of the invention showing a bed and associated desk in a position intermediate the stored and in use positions of the bed.

In the embodiments of both FIG. 1 and FIG. 7 the force required to move the bed platforms 17 and 100 may be regulated by spring mechanisms 60 so that only a modest force, such as just sufficient to overcome inertia, need be applied to move the embodiments between their extreme positions so that the structures can be easily operated by a person of very modest strength.

Although several embodiments of the invention have been illustrated and described, it should be understood that the invention should not be limited to the precise structure shown but rather only by the appended claims when interpreted in light of the relevant prior art.

The invention claimed is:

1. In a lever actuated spring mechanism for a bed platform which swings upwardly to a bed platform out of use position and downwardly to a bed platform in use position, said bed platform having a stationary bed platform receiving structure, the combination of a spring mechanism fixed to the stationary bed platform receiving structure, said spring mechanism enabling the bed platform to be positioned in a generally vertical position and a generally horizontal position, and all positions there between, said spring mechanism including a base member fixed to the stationary bed platform receiving structure, which base member remains stationary in all positions of the bed platform from generally vertical to generally horizontal, a lever pivotally connected to the stationary base member, means for fixedly connecting the bed platform to the lever in all positions of the bed platform with respect to the stationary base member including the beginning connection of the bed platform to the spring mechanism, tension springs, said tension springs being anchored at their first ends to the stationary base member and at their other ends to a spring anchor, said first ends of the tension springs remaining spatially fixed in all positions of the bed platform from generally vertical to generally horizontal, and mechanical adjustment means on the spring anchor located between the other ends of the tension springs and the lever, said mechanical adjustment means being operable by a tool which is held at a location remote from the spring anchor for adjusting the position of the lever to the stationary base member in all positions of the lever with respect to the stationary base member, said mechanical means including, spaced, aligned, internally threaded bosses on the spring anchor, and a threaded eye-bolt which is pivotally connected at its eye end to the lever at a pivot location which lies above the pivot connection of the lever to the stationary base member, the inner threaded end of the threaded eye-bolt being received in the spaced, aligned internally threaded bosses.

2. The structure of claim 1 further characterized in that the mechanical adjustment means on the spring anchor for adjusting the position of the lever with respect to the stationary base member includes a nut threaded on the eye-bolt between the bosses whereby rotation of the nut by a tool held at a location remote from the anchor member will cause proportional movement of the eye-bolt and consequently a change of position of the lever with respect to the stationary base member.

* * * * *